US006098853A

United States Patent [19]

Beitz

[11] Patent Number: 6,098,853

[45] Date of Patent: Aug. 8, 2000

[54] ABSORBENT GLOVE TREE

[76] Inventor: Stephen P. A. Beitz, P.O. Box 3357, Yountville, Calif. 94599

[21] Appl. No.: 09/313,946

[22] Filed: May 18, 1999

Related U.S. Application Data

[60] Provisional application No. 60/086,056, May 19, 1998.

[51] Int. Cl.[7] ..... A41D 1/00

[52] U.S. Cl. ..... 223/80; 223/78

[58] Field of Search ..... 223/78, 79, 80, 223/84, 66

[56] References Cited

U.S. PATENT DOCUMENTS

| | | | |
|---|---|---|---|
| 1,805,709 | 5/1931 | Thoma | 223/78 |
| 3,159,504 | 12/1964 | Sarjanian | 223/78 |
| 4,018,382 | 4/1977 | DiCuya | 223/78 |
| 4,565,287 | 1/1986 | Rede et al. | 223/78 |
| 4,697,724 | 10/1987 | Pitcher et al. | 223/78 |
| 5,234,141 | 8/1993 | Spiece | 223/78 |

*Primary Examiner*—Bibhu Mohanty
*Attorney, Agent, or Firm*—Bruce H. Johnsonbaugh

[57] ABSTRACT

An absorbent glove tree is provided having a single piece body section with a palm portion and four fingers. The body is tapered and thicker at the base of the palm to securely hold a leather glove on the tree without the use of a clip. A removable thumb portion is provided along with a flexible mounting spring or rod so that the thumb articulates relative to the body as a glove is being fitted onto the tree. The thumb may be attached to either side of the body to accept either left or right handed gloves.

2 Claims, 3 Drawing Sheets

ABSORBENT GLOVE TREE

CROSS REFERENCE TO RELATED APPLICATION

This application claims the benefit of U.S. Provisional Application Serial No. 60/086,056 filed May 19, 1998.

BACKGROUND AND BRIEF SUMMARY OF INVENTION

This invention provides an absorbent glove tree primarily for use with leather golf gloves and other leather gloves.

The prior art glove tree, shown in U.S. Pat. No. 5,234,141, requires the use of a relatively expensive and cumbersome clip to hold the glove to the glove tree. Other prior art designs include rather cumbersome and expensive designs to manufacture, in that they contain numerous parts and/or articulating joints, such as U.S. Pat. Nos. 4,697,724, 5,125,169, 4,018,382 and 2,281,741. The present invention provides an inexpensive glove tree preferably made of perforated aromatic cedar.

DETAILED DESCRIPTION OF THE DRAWINGS

Figure 1:
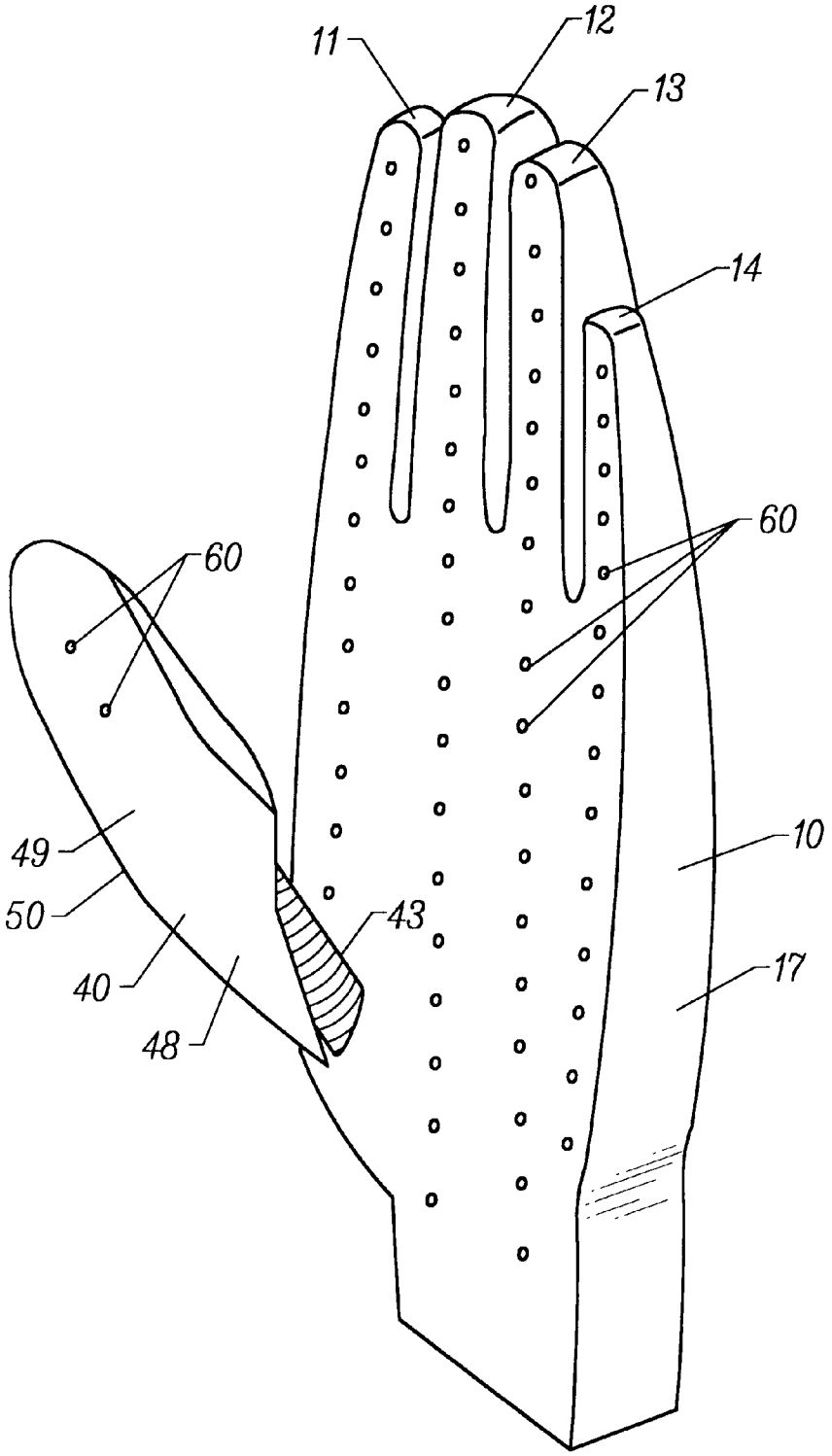
FIG. 1 is a perspective view of the glove tree according to the present invention.
Figure 2:
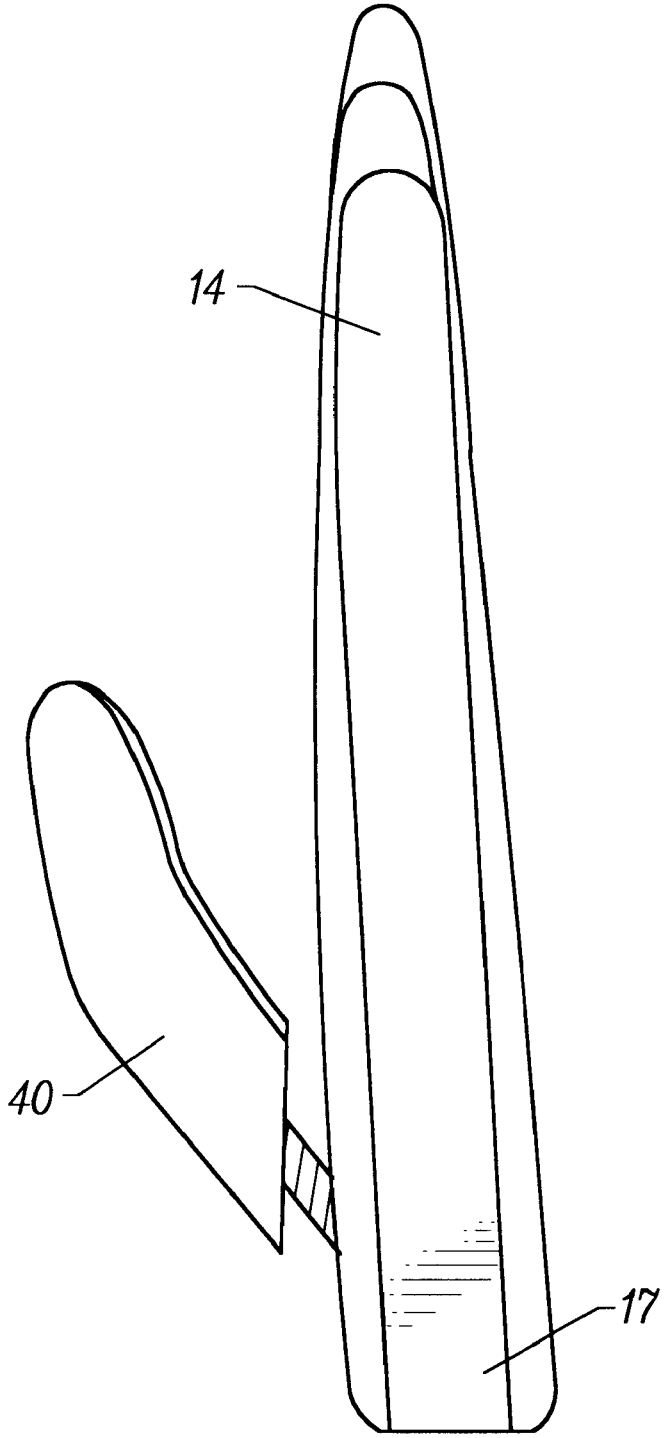
FIG. 2 is a side elevational view of the glove tree shown in FIG. 1.
Figure 3:
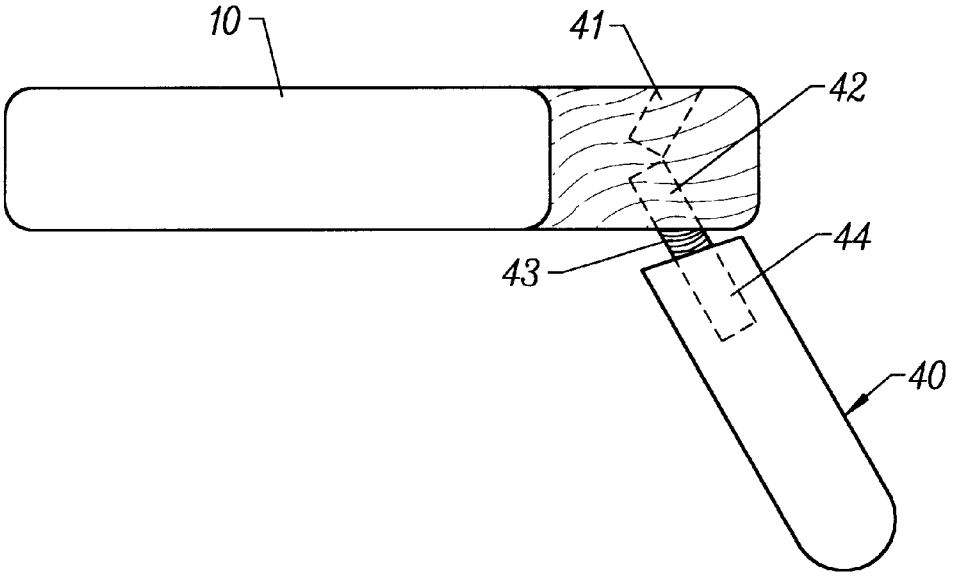
FIG. 3 is a plan view, partially in section, of the glove tree shown in FIG. 1.

The design of the present invention is shown in FIGS. 1, 2 and 3. As shown in the figures, the preferred design includes a main portion 10 and a removable thumb 40. The main or body portion 10 has four fingers 11–14. The main or body portion also is tapered and has a somewhat enlarged palm portion 17. As shown in FIG. 2, the base of palm portion 17 is considerably thicker than the finger 14 so that the glove, when pulled over the glove tree, is taut and does not need a clip to hold the glove to the base 17 of the glove tree, as is required in U.S. Pat. No. 5,234,141.

The thumb member 40 may or may not be used in conjunction with the body portion 10. As shown best in FIG. 3, the body portion 10 has two passageways 41 and 42 drilled therein for receiving a flexible thumb connection means which, as shown in FIG. 3, is helical spring 43. Helical spring 43 extends into a passageway 44 formed in the thumb portion 40. By inserting helical spring 43 into passageway 42, as shown in FIG. 3, the assembled glove tree is set to receive a left handed glove. By removing thumb 40 and spring 43 from passageway 42 and inserting the spring 43 into passageway 41, the assembled glove tree will accept a right handed glove. The assembly is therefore readily adapted to receive either a left handed or right handed glove. The assembly can also be used without the removable thumb piece 40. As shown best in FIG. 1, thumb piece 40 has a lower section 48 and upper portion 49 and a knuckle portion 50, which closely resemble the shape of the human thumb. The thumb design shown in the figures more closely resembles the shape of the human thumb and forms a more effective support for the thumb of the glove than do the prior art glove trees.

Another advantage of the spring mounted removable thumb 40 is that the helical spring 43 is very flexible and allows the thumb piece 40 to pivot relative to the body portion 10 as the glove is being drawn over the fingers and thumb piece 40. The articulating thumb piece 40 allows the user to readily insert the thumb piece 40 into the thumb of the glove. The use of the tapered body and snug fitting thumb piece 40 totally removes the requirement for the use of a rather cumbersome clip as taught by the Spiece U.S. Pat. No. 5,234,141.

Figure 4:
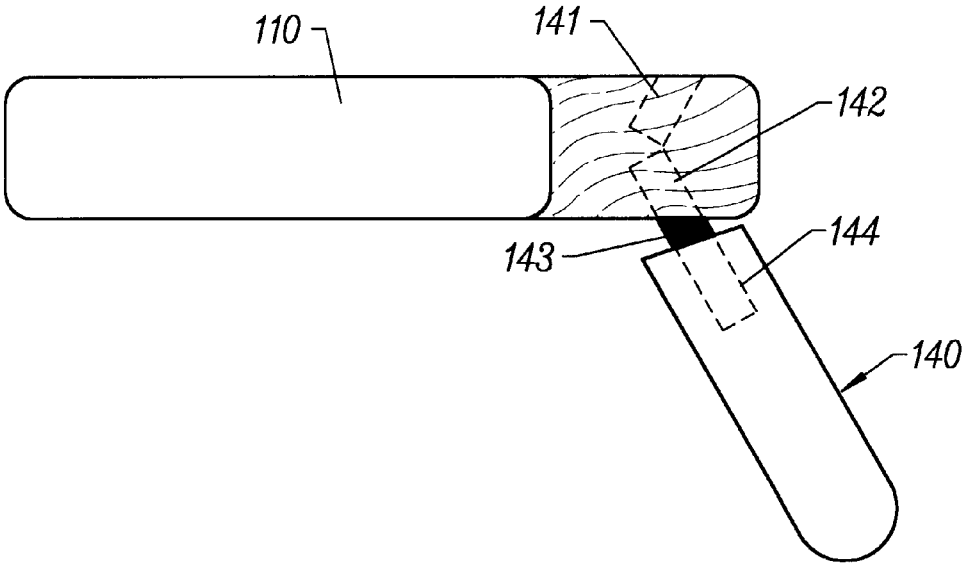
FIG. 4 is a plan view, partially in section, of an alternate embodiment of the invention.

FIG. 4 shows a second embodiment of the invention wherein a flexible, solid plastic rod 143 is utilized to connect the removable thumb 140 to body 110. Rod 143 may be inserted into either of passageways 141 or 142 formed in body 110 for use with a right or left handed glove.

The glove tree of the present invention is preferably made in various sizes to provide a snug fit for the glove. Perforations 60 are preferably used throughout the body portion and thumb portion.

In addition to aromatic cedar, the glove tree of the present invention can also be made of white oak, ceramic material or other materials which are relatively sturdy, inexpensive and absorbent.

What is claimed is:

1. An absorbent glove tree for use with a leather glove, comprising:

a single piece body including a palm portion and four fingers connected to said palm portion, said palm portion having a base, said single piece body being free of any moving parts, said body being tapered to have a greater thickness at the base of the palm section than at the fingers, a removable thumb, and flexible thumb connection means for connecting said removable thumb to said body so that said thumb is aligned relative to said palm portion with substantially the same alignment as in a human hand and wherein said thumb is free to articulate relative to said body to facilitate insertion of said removable thumb into the thumb of said leather glove.

2. The glove tree of claim 1 wherein said flexible thumb connection means comprises two passage ways formed in said body, one for use with a left handed glove and the other adapted for use with a right handed glove.

* * * * *